US009133539B2

(12) United States Patent
Hayton

(10) Patent No.: US 9,133,539 B2
(45) Date of Patent: Sep. 15, 2015

(54) METHOD AND EQUIPMENT FOR SHAPING A CAST COMPONENT

(71) Applicant: ROLLS-ROYCE PLC, London (GB)

(72) Inventor: Paul Robert Hayton, Bristol (GB)

(73) Assignee: ROLLS-ROYCE plc, London (GB)

( * ) Notice: Subject to any disclaimer, the term of this patent is extended or adjusted under 35 U.S.C. 154(b) by 264 days.

(21) Appl. No.: 13/632,567

(22) Filed: Oct. 1, 2012

(65) Prior Publication Data

US 2013/0089458 A1 Apr. 11, 2013

(30) Foreign Application Priority Data

Oct. 6, 2011 (GB) ..... 1117183.2

(51) Int. Cl.

| | |
|---|---|
| ***B21D 3/00*** | (2006.01) |
| ***C22F 1/18*** | (2006.01) |
| ***B21D 3/10*** | (2006.01) |
| ***B21D 3/12*** | (2006.01) |
| ***B21D 37/10*** | (2006.01) |
| ***B21J 5/02*** | (2006.01) |
| ***B21J 5/06*** | (2006.01) |
| ***B21J 13/02*** | (2006.01) |

(Continued)

(52) U.S. Cl.

CPC . *C22F 1/183* (2013.01); *B21D 3/10* (2013.01); *B21D 3/12* (2013.01); *B21D 3/16* (2013.01); *B21D 35/005* (2013.01); *B21D 37/10* (2013.01); *B21J 5/02* (2013.01); *B21J 5/06* (2013.01); *B21J 13/02* (2013.01); *C22C 14/00* (2013.01)

(58) Field of Classification Search

CPC ..... B21D 5/00; B21D 130/00; B21D 22/02; B21D 22/022; B21D 3/10; B21D 3/12; B21D 3/14; B21D 3/16; B21D 37/10; B21J 5/00; B21J 9/00; B21J 13/00; B21J 17/00; B21J 5/02; B21J 5/06; B21J 13/02; B21K 29/00; B21K 3/00; B21K 1/00; B22D 3/00; B22D 5/00; B22D 19/00; B22D 27/00

USPC ..... 72/342.1, 342.94, 364, 465.1, 466.8, 72/469, 31.01, 31.02, 455, 470, 362, 411, 72/429, 457, 462, 700, 701; 29/889.1

See application file for complete search history.

(56) References Cited

U.S. PATENT DOCUMENTS 3,635,068 A 1/1972 Watmough et al.
5,819,573 A * 10/1998 Seaman ..... 72/60

(Continued)

FOREIGN PATENT DOCUMENTS

EP 0 448 339 A1 9/1991
EP 2 295 164 A2 3/2011

(Continued)

OTHER PUBLICATIONS

Feb. 6, 2013 European Search Report issued in European Application No. EP 12 18 6857.

(Continued)

*Primary Examiner* — Debra Sullivan
(74) *Attorney, Agent, or Firm* — Oliff PLC

(57) ABSTRACT

A method for shaping a component cast from a titanium alloy including firstly heating the component to a plastic temperature such that it becomes plastically deformable and subsequently subjecting the component to a deformation process to thereby plastically deform the component to a desired geometric shape.

19 Claims, 3 Drawing Sheets

(51) Int. Cl.

| | |
|---|---|
| ***B21D 3/16*** | (2006.01) |
| ***B21D 35/00*** | (2006.01) |
| ***C22C 14/00*** | (2006.01) |

(56) References Cited

U.S. PATENT DOCUMENTS

| | | | | |
|---|---|---|---|---|
| 5,933,951 | A * | 8/1999 | Bergue et al. | 29/889.72 |
| 2003/0088958 | A1 * | 5/2003 | Wah | 29/23.51 |
| 2006/0272380 | A1 | 12/2006 | Storsberg et al. | |
| 2009/0255115 | A1 | 10/2009 | Kernozicky et al. | |

FOREIGN PATENT DOCUMENTS

| | | | |
|---|---|---|---|
| EP | 2 407 565 | A1 | 1/2012 |
| GB | 2 073 631 | A | 10/1981 |
| GB | 2 390 048 | A | 12/2003 |
| JP | A-55-021507 | | 2/1980 |
| JP | A-62-170464 | | 7/1987 |
| JP | A-7-180013 | | 7/1995 |
| JP | A-8-081747 | | 3/1996 |
| JP | A-2007-044763 | | 2/2007 |

OTHER PUBLICATIONS

Jan. 26, 2012 Search Report issued in British Application No. GB1117183.2.

* cited by examiner

METHOD AND EQUIPMENT FOR SHAPING A CAST COMPONENT

This invention claims the benefit of UK Patent Application No. 1117183.2, filed on 6 Oct. 2011, which is hereby incorporated herein in its entirety.

FIELD OF THE INVENTION

The present disclosure relates to a method of shaping or reshaping a cast component.

BACKGROUND TO THE INVENTION

It is well known to form components by casting methods using molten metals, and that the casting may deform as it cools due to shrinkage. In particular it may bend and/or twist as it cools. Where the casting is heat treated to remove inherent stresses built up in the casting as it was formed and cooled, the casting may further deform.

The dimensional accuracy of the component may be achieved by machining to the correct dimensions. However, because of the inherent strain in the component, this may result in further distortions as any weakened portions of the component yield to the inherent stresses. This makes machining difficult and increases cost and time and requires the part to have a greater level of restraint during machining.

Alternatively the component may be deformed by bending, pressing or other mechanical working method, literally forcing it to take up the desired shape. Mechanical working is very unsatisfactory as the mechanical strain introduced during manipulation is often found to relax over time. The consequence of this is that material of the component creeps during its operational life and hence the component may change shape and no longer conform to desired dimensions, despite it being dimensionally accurate upon completion of its manufacture. This results in operational non-conformance which is highly problematic for the functioning of mechanical hardware, especially those used for flight.

Mechanical working may introduce further residual strain in the component. For many applications the presence of high internal stress and strain will not be an issue.

However, for other applications it is, and may increase the chance of the component having a shortened operational life.

Typically this problem is resolved by either accepting the reduced life, or making the component from thicker material so that it can deal with higher loads (i.e., the operational load plus the residual stressed present in the component). However, increasing the material thickness may compound the problem.

Additionally, if the casting is large and rigid, the equipment required to mechanically work the component must be capable providing a great deal of force, and hence are highly specialist and expensive pieces of equipment (for example, large hydraulic presses.)

Hence a method and apparatus which enable the shaping or reshaping of cast components which do not increase the residual stress and/or strain in the component, and which does not require the use of expensive equipment is highly desirable.

STATEMENTS OF INVENTION

Accordingly there is provided a method for shaping a component cast from a titanium alloy comprising the steps of: heating the component to a plastic temperature such that it becomes plastically deformable; and subjecting the component to a deformation process to thereby plastically deform the component to a desired geometric shape.

Thus distortions in the component can be corrected without inducing further stress or strain in the component, and with the application of a relatively low force compared to known processes.

Other aspects of the invention provide devices, methods and systems which include and/or implement some or all of the actions described herein. The illustrative aspects of the invention are designed to solve one or more of the problems herein described and/or one or more other problems not discussed.

BRIEF DESCRIPTION OF THE DRAWINGS

Examples of the present disclosure will now be described with reference to the accompanying drawings, in which.

It is noted that the drawings may not be to scale. The drawings are intended to depict only typical aspects of the invention, and therefore should not be considered as limiting the scope of the invention. In the drawings, like numbering represents like elements between the drawings.

DETAILED DESCRIPTION

Figure 1:
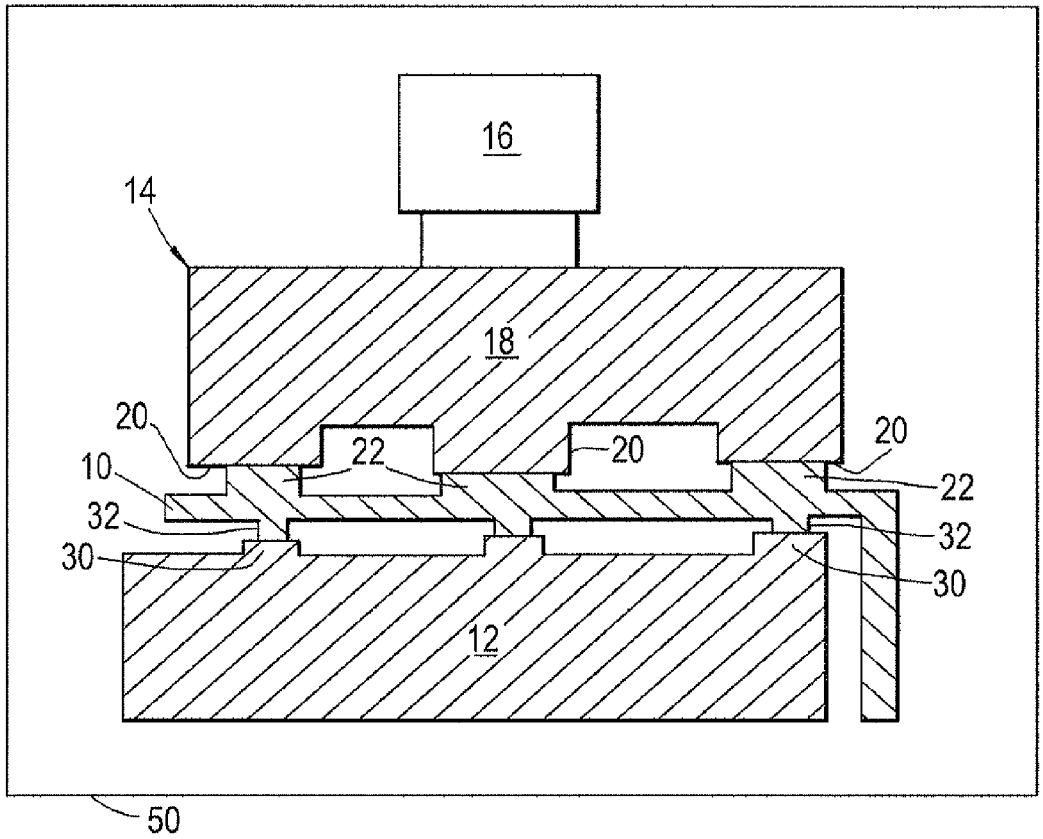
FIG. 1 shows a component mounted between a first example of a deformation member and a base member.
Figure 2:
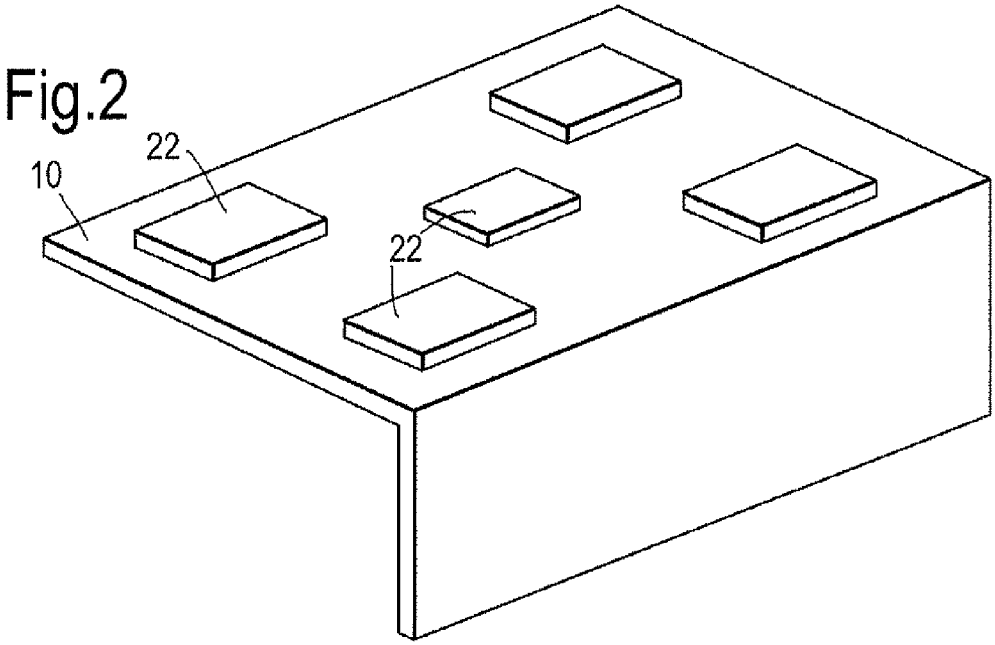
FIG. 2 shows a perspective view of one example of the component.
Figure 3:
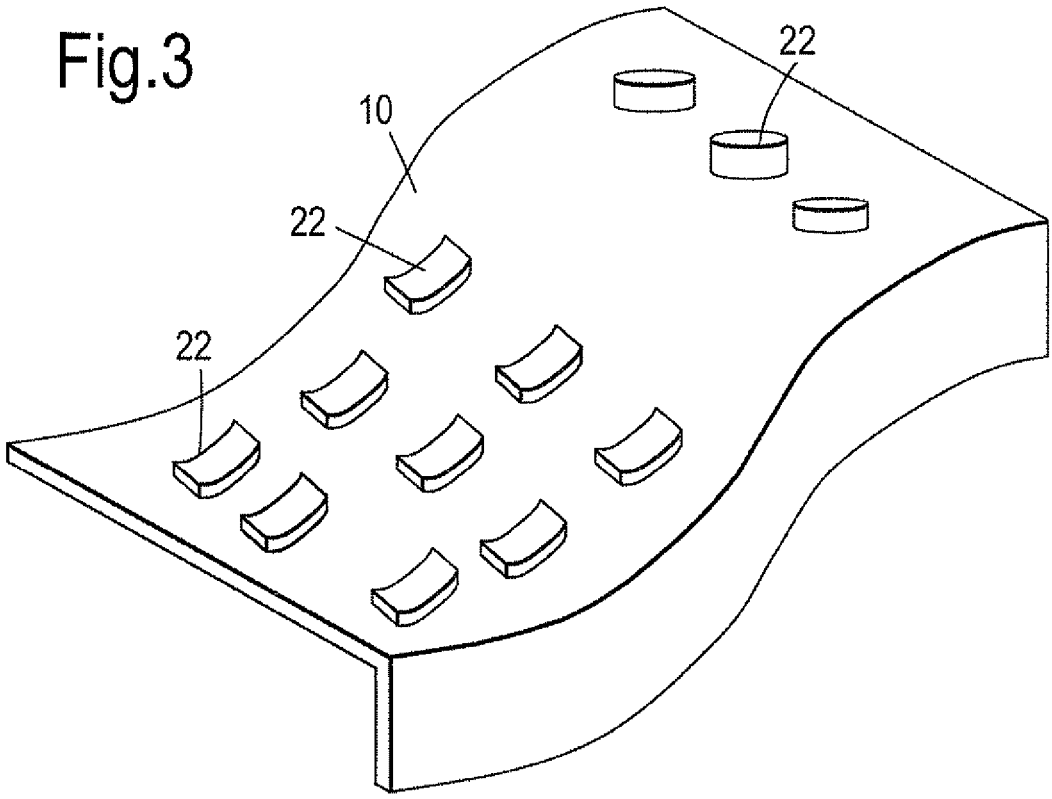
FIG. 3 shows a perspective view of an alternative example of the component.
Figure 4:
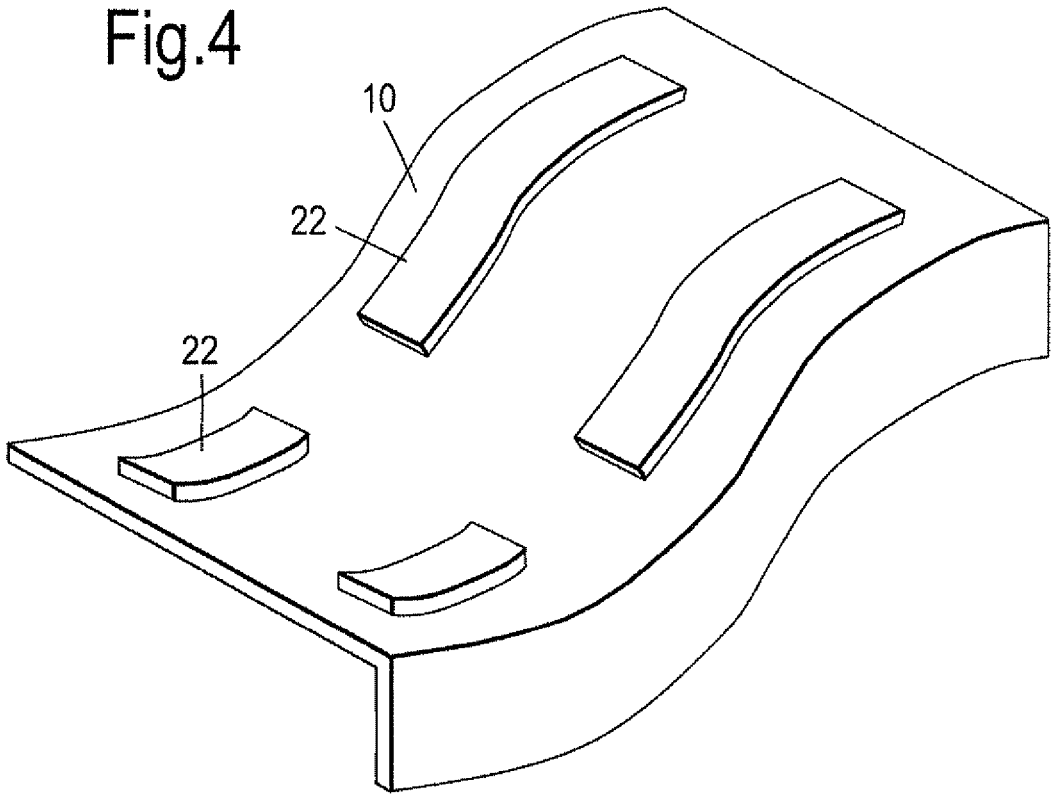
FIG. 4 shows a perspective view of an alternative example of the component.

FIG. 1 shows a component 10 mounted on base member 12 with a deformation member 14 placed upon the component 10. The component 10 is a casing made by a casting process from a titanium alloy. The titanium alloy may be titanium 6-4. In the example shown the casting 10 is a section of at least part of an exhaust duct for a gas turbine engine. The casting 10 is substantially "L" shaped in cross-section, and extends in a direction into and out of the page as shown in FIG. 1. That is to say, it has the general form of a "L" beam, as shown in FIG. 2 and FIG. 3. The cast component 10 may extend in a planar direction, as shown in FIG. 2, or may be curved, as shown in FIG. 3 and FIG. 4. As shown in FIG. 3 and FIG. 4 the component may have at least one wall which is double curved such that it is "S" shaped, or have a single curve.

The deformation member 14 is configured to engage with at least a part of the surface of the casing component 10. In the example of FIG. 1 the deformation member 14 is in communication with a pneumatic or mechanical ram 16 (which may comprise a lever arrangement) configured to press down on the deformation member 14. However, the ram mechanism 16 is optional, and in other examples the weight of the deformation member 14 acting under the force of gravity is sufficient to provide adequate force on the casting 10. The deformation member 14 comprises a substantially rigid body 18.

The rigid body of the deformation member 14 is provided with location features 20 for engagement with the surface of the component 10, the location features 20 defining the desired component geometric shape of the component 10. The cast component 10 is provided with a first set of location pads 22 for engagement with the location features 20 of the rigid body 18. As shown in FIG. 3 the location pads 22 may take the form of substantially square raised regions, or substantially circular raised regions.

Alternatively, as shown in FIG. 4, the location pads 22 may take the form of substantially rectangular raised regions which extend along a surface of the component 10. The location pads may be spaced apart at intervals of at least 25 mm but no more than 250 mm. The base member 12 is provided with location features 30 for engagement with the surface of the component 10, the location features 30 defining the desired component geometric shape. The component 10 is also provided with location pads 32 for engagement with the location features 30 of the base member 12.

Figure 5:
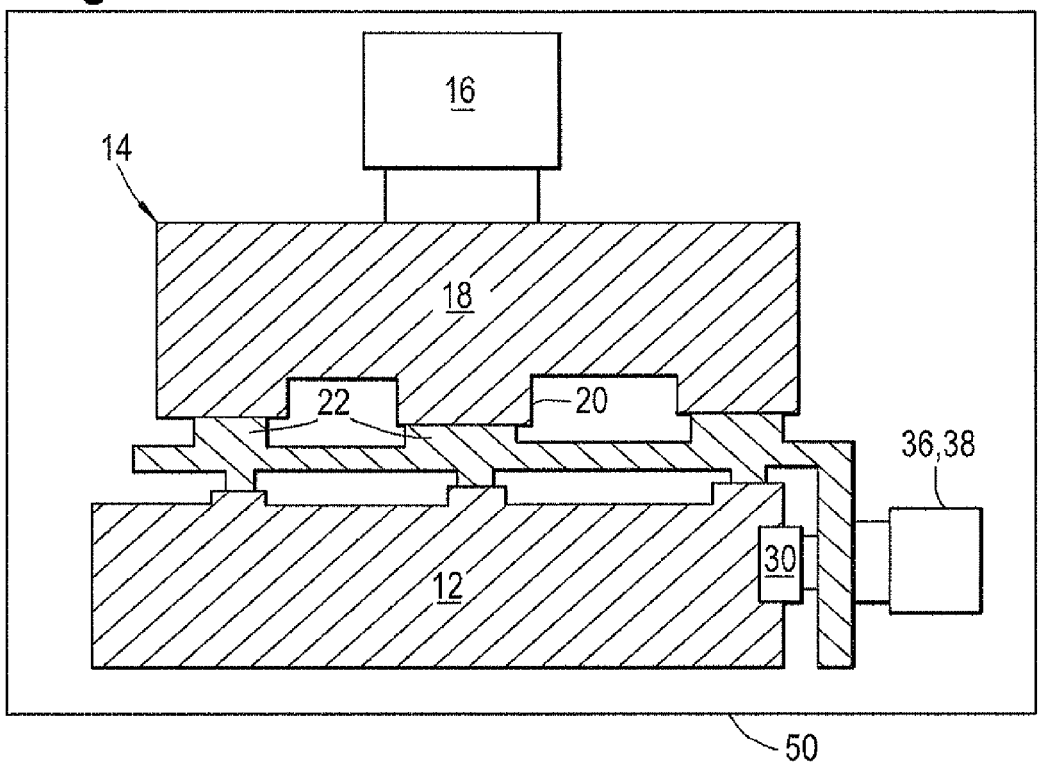
FIG. 5 shows an alternative arrangement to that shown in FIG. 1.

An alternative arrangement is shown in FIG. 5. This arrangement is substantially as that shown on FIG. 1, except the base member 12 is provided with a location feature 30 on a plurality of surfaces of the base member 12. In this example the location features 30 are provided on surfaces which are at right angles to one another to match the shape of the casting 10. A second ram 36 is provided as a deformation member 38 at an angle to the vertical direction (as shown in the figures), and is configured to apply a force at an angle to the direction of force applied by deformation member 14 under the force of gravity and/or as applied by the first ram 16 (in examples where the first ram 16 is present). In the example shown the second ram 36 deformation member 38 is orientated at 90 degrees to vertical direction, and is configured to apply a force at right angles to the direction of force applied by deformation member 14 under the force of gravity and/or as applied by the first ram 16 (in examples where the first ram 16 is present). In alternative examples (not shown) the second ram 36, or further rams, may be provided such that they can apply a force in a direction substantially opposite to the direction of the first ram 16, with the second or further ram being offset from the first ram 16.

Figure 6:
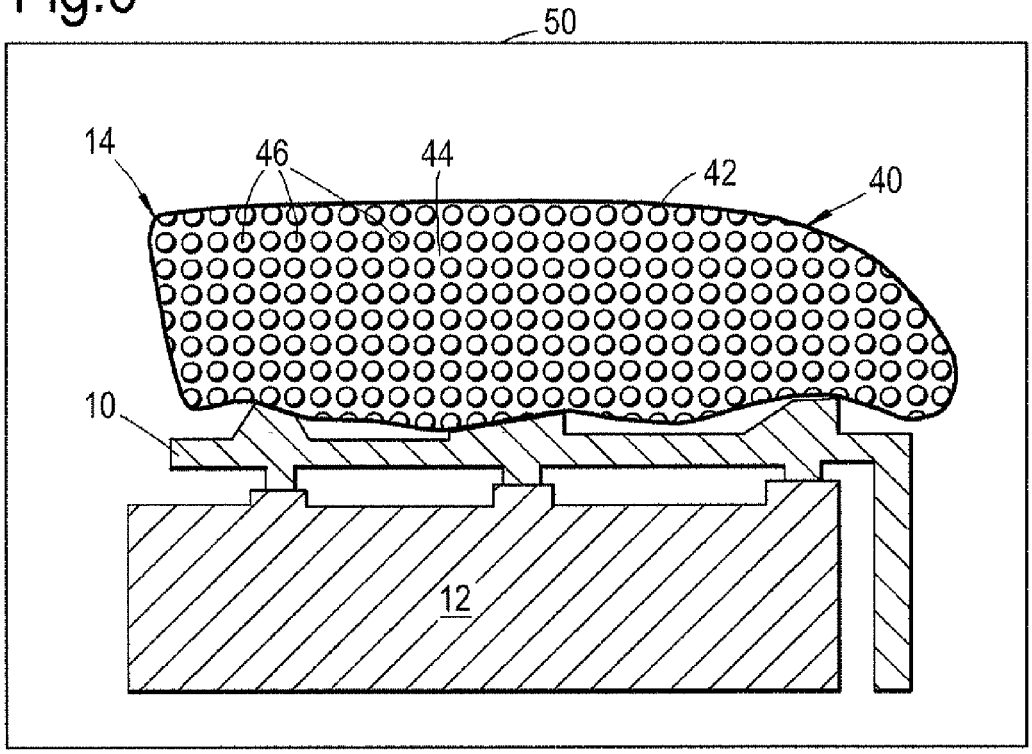
FIG. 6 shows of a component mounted between a second example of a deformation member and a base member.

An alternative arrangement is shown in FIG. 6. This is similar to the example shown in FIG. 1 except that the deformation member 14 in this example is a vessel 40 having a flexible wall 42 which defines a cavity 44, the cavity 44 at least partially filled with a plurality of weights 46. In this example, the deformation member 14 will conform to the surface of the component 10 and hence location pads 22 on the surface of the component in contact with the deformation member 14 are not required.

In FIG. 1, FIG. 5 and FIG. 6 the deformation member 14, component 10 and base member 12 are mounted relative to one another such that the deformation member 14 exerts a force on the component 10 in at least a substantially vertical downward direction, where downward is from top to bottom as shown in the figures. In the example shown in FIG. 5, the second ram 36 exerts a force on the component 10 in a direction at an angle to the vertical direction.

In another example, the base member 12 is configurable to alter the orientation of the component 10 relative to the deformation member 14, to thereby change the direction in which the deformation member 14 exerts a force on the component 10.

The surface of the location pads 22,32 may be at right angles (i.e. perpendicular) to the direction of the load path. That is to say, the surface of the location pads should be configured such that they are perpendicular to the direction in which a force is to be applied to the component 10. This prevents movement of the component 10 relative to the deformation member 14 and/or base member 12 as a result of force applied during the deformation process.

In the examples of FIG. 1, FIG. 5 and FIG. 6, the surface of the deformation member 14 and/or base member 12 may be made from a ceramic or other high temperature capable material that is inert with respect to the material of the component 10.

The assembly of component 10, deformation member 14 and base member 12 are placed in a furnace 50 at least during the shaping or reshaping process.

The method of the present disclosure, that is to say the method for shaping or reshaping a component cast from a titanium alloy, comprises the following steps.

The actual geometric shape of the component 10 prior to being shaped is determined, for example by measurement. The actual geometric shape is compared to the desired geometric shape. The region, or regions, of the component to apply force(s) to achieve the desired geometric shape are determined. The magnitude of the force or forces required to achieve the desired geometric shape are determined. The direction relative to the surface of the component to apply the required force or force(s) to achieve the desired geometric shape is determined.

The component 10 is then placed on the base member 12, and the deformation member 14 is placed upon the component 10. Rams 16, 36 (for example as shown in FIG. 1 and FIG. 5) are positioned as required. In examples where location pads 22,32 are provided on the component 10, and location features 20,30 are provided on the deformation member 14 and base member 12 respectively, there may be a gap between at least some of the location pads 22,32 and their respective location features 20,30. This is because the component 10 does not at this stage, i.e. pre-deformation, have the desired geometry, and so all the features of the component 10 may not line up with all the corresponding features of the deformation member 14 and base member 12.

The assembly of component 10, deformation member 14 and base member 12 are heated in the furnace 50 to the component's 10 plastic temperature such that it becomes plastically deformable. For a component 10 made from titanium 6-4, the plastic temperature is above 800° C. In particular, it is at least 820° C. and no more than 860° C. The component 10 is then subjected to a deformation process to thereby plastically deform the component 10 to a desired geometric shape.

The deformation process comprises the step of applying the predetermined force(s) in the predetermined direction(s) to the at least one predetermined region of the component 10 while the component 10 is at the plastic temperature. The component 10 is held at plastic temperature at least until the deformation process is complete. At least one region of the component 10 is deformed such that it conforms to the desired geometric shape, while the remaining regions of the component 10 may not be deformed. The temperature of the component 10 is then reduced to below the plastic temperature.

The force is applied by the deformation member 14 which, as described above, is configured to engage with at least a part of the surface of the component 10. A pneumatic or mechanical ram 16 may act upon the deformation member 14 to provide at least part of the required force. In examples where location pads 22 are provided on the component 10, the force is communicated from the deformation member 14 to the location pads 22, and reacted at these locations by the base member 12. In examples where location pads 22,32 are provided on the component 10, and location features 20,30 are provided on the deformation member 14 and base member 12 respectively, the force is communicated from the location features 20 of the deformation member 14 to the location pads 22 of the component, and reacted at these locations by the base member 12 location features 30.

In the examples shown in FIGS. 1, 4 and 5 the deformation member 14 exerts a force on the component 10 in a substantially vertical direction. In alternative examples the base member 12 is configurable to alter the orientation of the component 10 relative to the deformation member 14.

In all examples, the component 10 is bent and/or twisted during the deformation process such that the component 10 is deformed to conform to the features of the base member 12. Where the deformation member 14 is a rigid body, for example as described with reference to FIG. 1, the component 10 is also deformed to conform to the features of the deformation member 14 during the deformation process.

The component 10 may be bent and/or twisted in one or more deformation processes, either in the same or different orientations as required to achieve the desired shape.

The volume of the component 10 remains substantially constant throughout the deformation process. The density of the component 10 remains substantially constant throughout the deformation process. The surface area of the component 10 remains substantially constant throughout the deformation process.

Additionally the topographical geometry of the component 10 remains substantially constant throughout the deformation process. That is to say, while the component 10 may be bent and/or twisted, the surface of the component 10 will not be distorted. That is to say, while the shape of the substrate which defines the component body may alter during the deformation process, distances between fixed points on the surface of the component will remain substantially constant. Likewise the wall thickness of the component will remain substantially constant.

The method of the present disclosure enables titanium or titanium alloy parts to be reworked, adjusted, shaped or reshaped such that they have the desired shape. In practice it has been found that components can be made to within 0.1 mm of their required dimension.

A component 10 made from a Titanium alloy, and in particular Titanium 6-4, has very little rigidity at elevated temperatures. The method of the present disclosure provides the advantage of limiting and controlling the amount of displacement when the part is heated.

The process produces a very stable part that will be less likely to deform in use and over time, and which may be machined with a reduced risk of deformation during the machining process.

Parts that have distorted during machining may also be corrected using this procedure. For example, this may be a repair or as a way of stabilising the part during manufacture.

The examples of the present disclosure have been described with reference to the manufacture of at least part of an exhaust duct for a gas turbine engine, where the part has an "L" shaped cross section. However, the apparatus and method are equally applicable to other components, having a different cross section, for applications other than for an exhaust for a gas turbine engine.

The foregoing description of various aspects of the invention has been presented for purposes of illustration and description. It is not intended to be exhaustive or to limit the invention to the precise form disclosed, and obviously, many modifications and variations are possible. Such modifications and variations that may be apparent to a person of skill in the art are included within the scope of the invention as defined by the accompanying claims.

What is claimed is:

1. A method for deforming a component cast from a titanium alloy, such that each of a volume or the component, a density of the component, and a surface area of the component remains substantially constant throughout a deformation process, the method comprising:

heating the component to a plastic temperature such that the component becomes plastically deformable;

applying a force in a predetermined direction to at least one region of the component while the component is at the plastic temperature, the force being applied by a deformation member configured to engage with a least a part of a surface of the component, the deformation member comprising a substantially rigid body, the substantially rigid body being provided with location features for engagement with the surface of the component, the location features defining a desired component geometric shape, and the component being provided with location pads for engagement with the location features of the substantially rigid body, the force being communicated from the deformation member to the location pads the reacted upon at the location pads by a base member; and reducing a temperature of the component to below the plastic temperature to thereby plastically deform the component to the desired component geometric shape.

2. The method as claimed in claim 1, wherein the component is held at the plastic temperature at least until the deformation process is complete.

3. The method as claimed in claim 1, wherein the at least one region of the component is deformed such that the component conforms to the desired component geometric shape, and remaining regions of the component are not deformed.

4. The method as claimed in claim 1, further comprising:

determining an actual geometric shape of the component prior to being heated to the plastic temperature;

comparing the actual geometric shape of the component to the desired component geometric shape;

determining one or more regions of the component at which to apply one or more forces to achieve the desired geometric shape of the component;

determining a magnitude of each of the one or more forces required to achieve the desired geometric shape;

determining one or more directions relative to the surface of the component at which to apply the one or more forces required to achieve the desired geometric shape; and subjecting the component to the deformation process defined by the one or more determined regions, the magnitude of each of the one or more forces, and the one or more directions of the one or more forces.

5. The method as claimed in claim 1, wherein the deformation member is in communication with, or comprises, a pneumatic or mechanical ram.

6. The method as claimed in claim 1, wherein the deformation member is a vessel having at least one flexible wall which defines a cavity, the cavity being at least partially filled with a plurality of weights.

7. The method as claimed in claim 1, wherein the component is located on the base member during the deformation process.

8. The method as claimed in claim 7, wherein the base member is provided with location features for engagement with the surface of the component, the location features of the base member defining the desired component geometric shape.

9. The method as claimed in claim 8, wherein the component is provided with location pads for engagement with the location features of the base member.

10. The method as claimed in claim 7, wherein base member is configurable to alter an orientation of the component relative to the deformation member.

11. The method as claimed in claim 1, wherein the deformation member exerts a force in a substantially vertical direction.

12. The method as claimed in claim 1, wherein the titanium alloy is titanium 6-4.

13. The method as claimed in claim 1, wherein the plastic temperature is above 800° C.

14. The method as claimed in claim 13, wherein the plastic temperature is at least 820° C. and not more than 860° C.

15. The method as claimed in claim 1, wherein the deformation process comprises bending the component.

16. The method as claimed in claim 15, wherein the deformation process comprises bending and twisting the component.

17. The method as claimed in claim 1, wherein the deformation process comprises twisting the component.

18. The method as claimed in claim 1, wherein the topographical geometry of the component remains substantially constant throughout the deformation process.

19. The method as claimed in claim 1, wherein the component comprises at least part of an exhaust duct for a gas turbine engine.

* * * * *